United States Patent [19]

Ueda

[11] 4,446,688

[45] May 8, 1984

[54] DOUBLE TWISTING MACHINE

[75] Inventor: Iwao Ueda, Osaka, Japan

[73] Assignee: Hamana Iron Work Co., Ltd., Osaka, Japan

[21] Appl. No.: 362,943

[22] Filed: Mar. 29, 1982

[30] Foreign Application Priority Data

Mar. 31, 1981 [JP] Japan ..... 56-45755

[51] Int. Cl.[3] ..... D01H 7/86

[52] U.S. Cl. ..... 57/58.65; 57/58.67; 57/58.32

[58] Field of Search ..... 57/264, 58.3, 58.32, 57/58.34, 58.49, 58.52, 58.54, 58.55, 58.61, 58.63, 58.67, 65, 66.5, 67, 68, 71, 92, 100, 58.36, 58.38, 58.68, 58.72, 58.81

[56] References Cited

U.S. PATENT DOCUMENTS

| | | | |
|---|---|---|---|
| 2,717,485 | 9/1955 | Pearce | 57/58.36 X |
| 2,873,569 | 2/1959 | Schinke et al. | 57/65 X |
| 3,425,203 | 2/1969 | Schillebeeckx | 57/58.55 X |
| 3,620,001 | 11/1971 | Daker et al. | 57/58.65 X |
| 3,812,666 | 5/1974 | Sarracino | 57/58.65 X |
| 3,945,182 | 3/1976 | Dover et al. | 57/67 X |

*Primary Examiner*—Donald Watkins

*Attorney, Agent, or Firm*—Sughrue, Mion, Zinn, Macpeak, and Seas

[57] ABSTRACT

A double twisting machine for winding a wire around a take-up roll has two motors for directly and separately driving each end of a flyer thereby eliminating the need for a driving shaft, driving pulleys and timing belts which substantially reduces the amount of noise generated by the machine and reduces its overall size.

5 Claims, 2 Drawing Figures

DOUBLE TWISTING MACHINE

BACKGROUND OF THE INVENTION

1. Field of the Invention

The present invention relates to a double twisting machine.

2. Description of the Prior Art

In a conventional double twisting machine, a driving shaft extends from one end of a flyer to the other end of the flyer in order to drive both ends of the flyer by means of one motor. However, in such a conventional double twisting machine, since the flyer is driven by means of a pulley, a timing belt and the like at both the ends of the driving shaft, a tremendous amount of noise is developed. The noise developed requires that some kind of soundproof means be provided which increases the size of the machine as a whole.

SUMMARY OF THE INVENTION

It is therefore an object of the present invention to provide a double twisting machine that generates a small amount of noise.

It is a further object to provide such a machine that does not require soundproofing means.

It is yet a further object to provide such a machine that is compact in size.

These and other objects are achieved by providing a double twisting machine which has a plurality of motors for driving both ends of a flyer. The plurality of motors eliminates the need of using a driving shaft, timing belt, pulley and the like to transfer a driving force generated by a single motor to each end of the flyer. Therefore less noise is developed and soundproofing means is not required, all of which substantially reduces the overall size of the machine.

DESCRIPTION OF THE PREFERRED EMBODIMENTS

Figure 1:
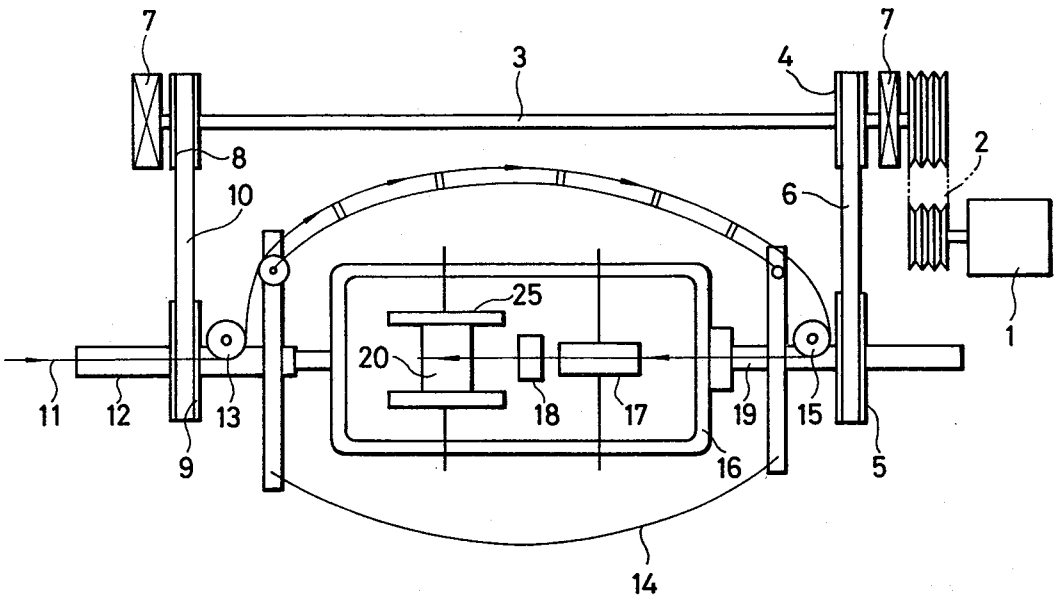
FIG. 1 PRIOR ART
FIG. 1 is a top view of a conventional prior art double twisting machine.

With reference to FIG. 1, a conventional double twisting machine has a single motor 1 which drives a driving shaft 3 which extends from one end of a flyer 14 to the other end of the flyer 14. A belt 2 is driven by the motor 1 so as to drive the shaft 3. Belt wheels 4, 8 are respectively mounted on both ends of the driving shaft 3. A timing pulley 5 is driven from the belt wheel 4 via a timing belt 6. Likewise, a second timing pulley 9 is driven from the belt wheel 8 via a second timing belt 10. Thus, the flyer 14 is driven at the right and left sides thereof. Both ends of the shaft 3 are supported by bearings 7, 7.

In operation, a wire 11 is guided from the left side in FIG. 1 so as to pass through a main shaft 12. Then the wire 11 enters the flyer 14 by way of a guide roll 13. After that, the wire 11 turns back at a guide roll 15 so as to pass through a second main shaft 19. By way of a capstan 17 which is mounted to a cradle 16, the wire 11 reaches a traverse 18 where the wire 11 is swung over the width of a take-up roll 25 and wound around a take-up bobbin 20.

Since the driving shaft 3 is used to drive both ends of the flyer by using a single motor, excessive noise is developed which requires that a noiseproof means be provided.

In order to remove these and other drawbacks, the present invention comprises a double twisting mechanism having a plurality of motors that directly drive both ends of the flyer. One embodiment of the present invention is shown in FIG. 2

Figure 2:
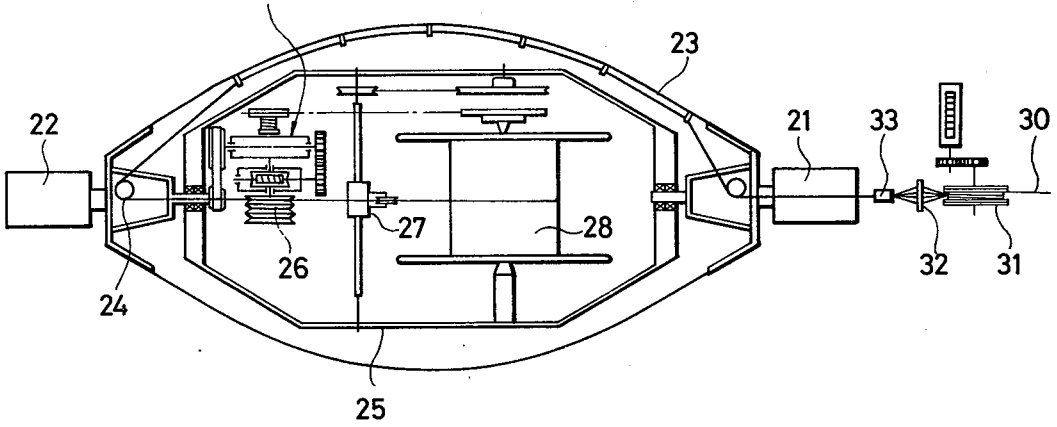
FIG. 2 is a top view of a double twisting machine built according with the present invention.

In FIG. 2, a flyer 23 is directly driven from both ends thereof by means of motors 21, 22. Reference numeral 24 denotes a guide roll, reference numeral 25 denotes a cradle, reference numeral 26 denotes a capstan which is mounted to the cradle 25, reference numeral 27 denotes a traverse, and reference numeral 28 denotes a take-up roll or bobbin. The shaft 3 which extends from one end to the other end of the flyer as mentioned before is not required. The flyer 3 is directly driven at both ends thereof by means of the plurality of motors 21, 22. Reference numeral 29 denotes a means for modifying the rotation speed of the capstan 26.

Since neither the timing belts 6, 10 nor the timing pulleys 5, 9 are used in the twisting machine in accordance with the present invention, excessive noise is not developed. In addition, it is not necessary to provide any noiseproofing means. Accordingly, the mechanism as a whole becomes compact and the area for mounting the mechanism becomes small.

Since the speed of the plurality of motors 21, 22 can be precisely controlled by electrical means, there is no difference between the machine of the present invention and the prior art machine as far as the effect to be brought about is concerned. For example, if a ten horse power motor is required in the prior art machine, two five horse power motors would be required in the machine built in accordance with the present invention. In addition, synchronized starting of the motors 21, 22 is not required. The simultaneous starting as well as the simultaneous stopping of the motors 21, 22 is sufficiently ensured by the internal strength of the flyer.

The operation of the twisting machine shown in FIG. 2 will be briefly explained. A wire 30 is guided from the right side in the drawing. By way of a measuring pulley 31, a scale plate 32 and die 33, the wire 30 enters the flyer 23. Then, the wire 30 turns back at the pulley 24. By way of the capstan 26, the wire 30 is swung at the traverse 27 over the width of the take-up roll and then wound around the take-up roll.

I claim:

1. A double twisting machine for winding a wire around a take-up roll, comprising:

a flyer having opposite ends; and a plurality of motors, said plurality of motors separately and directly driving each of said ends of said flyer so as to wind said wire around said take-up roll.

2. The double twisting machine claimed in claim 1 further comprising a measuring pulley, a scale plate and a die for guiding said wire before said wire enters said flyer.

3. The double twisting machine claimed in claim 2 further comprising first and second pulleys, a capstan, and a traverse for guiding said wire within said flyer to said take-up roll.

4. The double twisting machine as claimed in claim 3, further comprising means for modifying a rotational speed of said capstan.

5. The double twisting machine as claimed in claim 1, wherein said motors bearingly support said opposite ends of said flyer, said flyer having an internal strength sufficient to ensure simultaneous starting and stopping of said motors.

* * * * *